US006401396B1

(12) United States Patent
Koban et al.

(10) Patent No.: US 6,401,396 B1
(45) Date of Patent: Jun. 11, 2002

(54) DEVICE FOR GUIDING AND LIMITING THE TRAVEL OF A SLIDING DOOR ELEMENT

(75) Inventors: Johannes Koban, Stuttgart; Armin Breitenbuecher, Pluederhausen; Heinz Haug, Schwieberdingen; Hellmut Walter, Waiblingen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/787,227

(22) PCT Filed: Aug. 27, 1999

(86) PCT No.: PCT/DE99/02683

§ 371 (c)(1),
(2), (4) Date: Mar. 16, 2001

(87) PCT Pub. No.: WO00/15937

PCT Pub. Date: Mar. 23, 2000

(30) Foreign Application Priority Data

Sep. 16, 1998 (DE) ..... 198 42 295
Apr. 1, 1999 (DE) ..... 199 14 860

(51) Int. Cl.[7] ..... E05D 15/06
(52) U.S. Cl. ..... 49/404; 16/85; 16/86 A
(58) Field of Search ..... 49/404, 483.1, 49/449; 16/63, 85, 86 A, 86 R, DIG. 17

(56) References Cited

U.S. PATENT DOCUMENTS 2,899,256 A * 8/1959 Kelley ..... 49/483.1
3,907,021 A * 9/1975 Smith
5,517,721 A * 5/1996 Roth et al. ..... 16/86 R
5,735,511 A * 4/1998 Wibrow
5,791,723 A * 8/1998 Bell et al. ..... 49/483.1

FOREIGN PATENT DOCUMENTS

EP 0 814 226 S * 12/1997
FR 2 478 718 A * 9/1981
GB 2100780 * 1/1983 ..... 49/483.1
GB 2 321 269 A * 7/1998

* cited by examiner

*Primary Examiner*—Jerry Redman
(74) *Attorney, Agent, or Firm*—Michael J. Striker

(57) ABSTRACT

A device (10; 10*a*) for guiding and limiting the travel of a sliding door element (1) has a receiving and stop element (12; 12*a*; 12*b*; 12*c*) which cooperates by positive engagement with a centering element (11; 11*a*). It is proposed that the centering element (11; 11*a*) be embodied with a wedge-shaped portion (18; 29) and that the receiving and stop element (12; 12*a*; 12*b*; 12*c*) be embodied with a V-shaped portion (19; 40). The device (10; 10*a*) is especially simply embodied and requires only little effort for assembly.

17 Claims, 4 Drawing Sheets

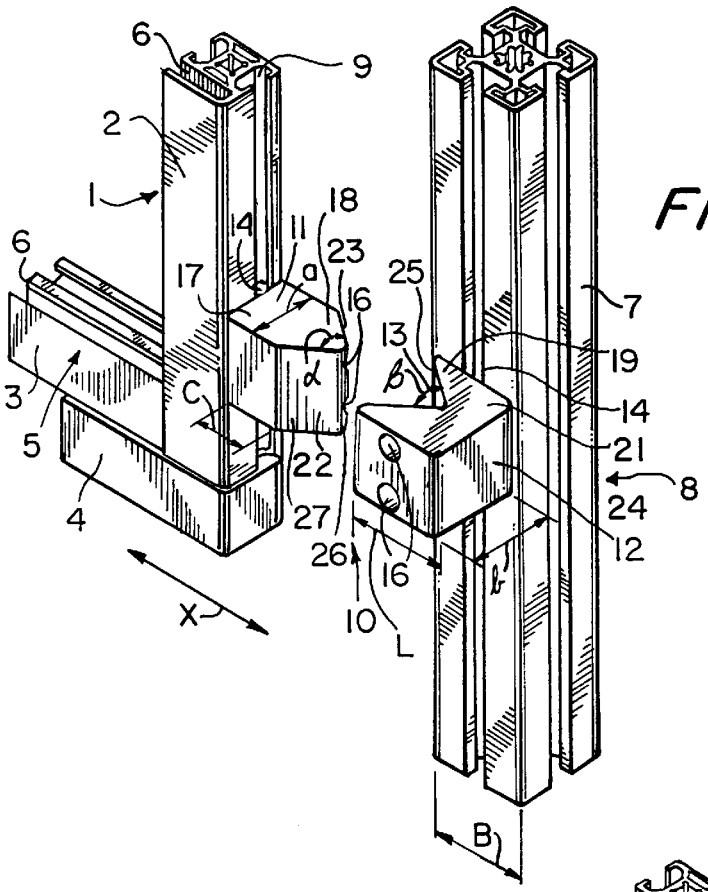
FIG. 1
FIG. 2
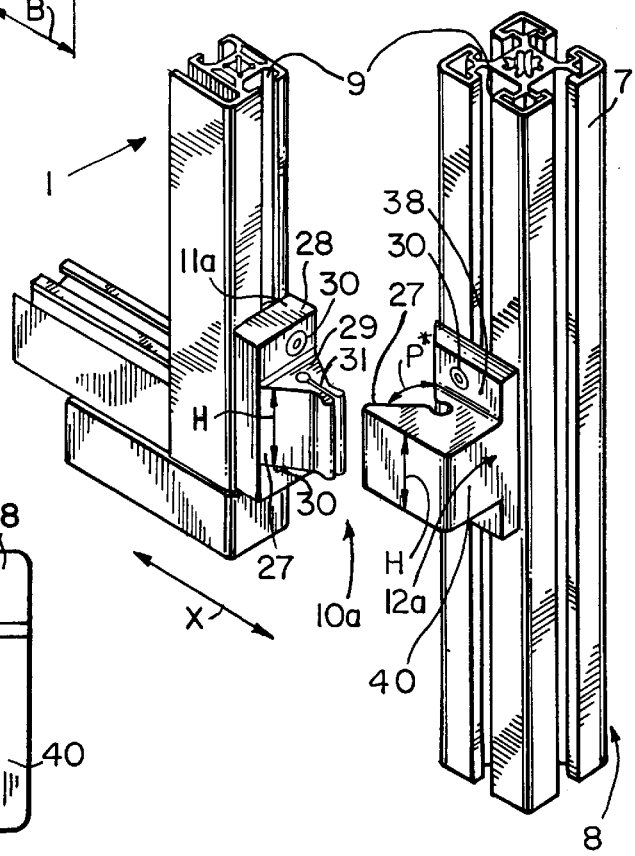
FIG. 3
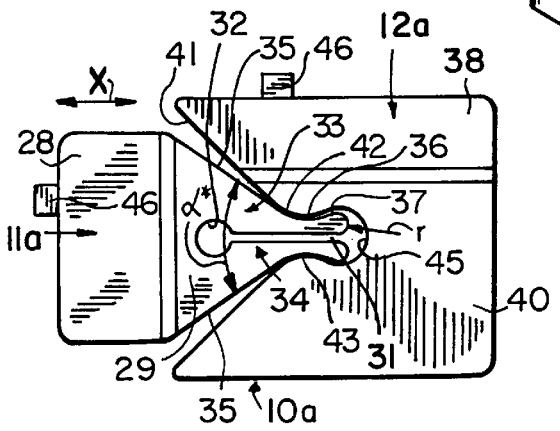

DEVICE FOR GUIDING AND LIMITING THE TRAVEL OF A SLIDING DOOR ELEMENT

BACKGROUND OF THE INVENTION

The invention relates to a device for guiding and limiting the travel of a sliding door element. One such device is already known that has a guide, fastened in the bottom region of a post of a guard fence, with a stop serving the purpose of travel limitation. The guide, embodied of an L-shaped steel profile, cooperates with a roller body, fastened to a cantilever, which body is secured to the sliding door element and can be introduced between the post and one leg of the steel profile A disadvantage here is that the known device comprises many parts, so that besides the relatively high production costs, major effort of assembly is also required. Furthermore, because of the half-round shape, toward the guide, of the roller body, although introducing the sliding door element between the post and the leg of the steel profile is possible, even if the sliding door element is not in an exactly aligned position because of variations in the sliding door guide, nevertheless the mechanical stress on the plastic roller body and its bearing is quite high.

SUMMARY OF THE INVENTION

The device according to the invention for guiding and limiting the travel of a sliding door element, has the advantage over the prior art that an especially secure, gentle introduction of the centering element into the receiving and stop element is made possible.

In a preferred embodiment of the invention, the centering element and the receiving and stop element are embodied in such a way that locking of the sliding door element is possible without additional parts.

In a further preferred embodiment, damping elements are provided, by which quiet introduction of the centering element into the receiving and stop element can be attained with simultaneous shock-absorbing action.

It is expedient, for these damping elements, to provide a through opening in a wall of a recess, in which through opening an extension can be disposed for securing the damping element in the recess.

BRIEF DESCRIPTION OF THE DRAWINGS

Exemplary embodiments of the invention are shown in the drawing and will be described in further detail below. Shown are:

FIG. 1, a perspective view of first device for guiding and limiting the travel of a sliding door element;

FIG. 2, a perspective view of a second device for guiding and limiting the travel of a sliding door element;

FIG. 3, a plan view on the connecting elements of the device of FIG. 2;

DESCRIPTION OF THE PREFERRED EMBODIMENTS

Figure 4:
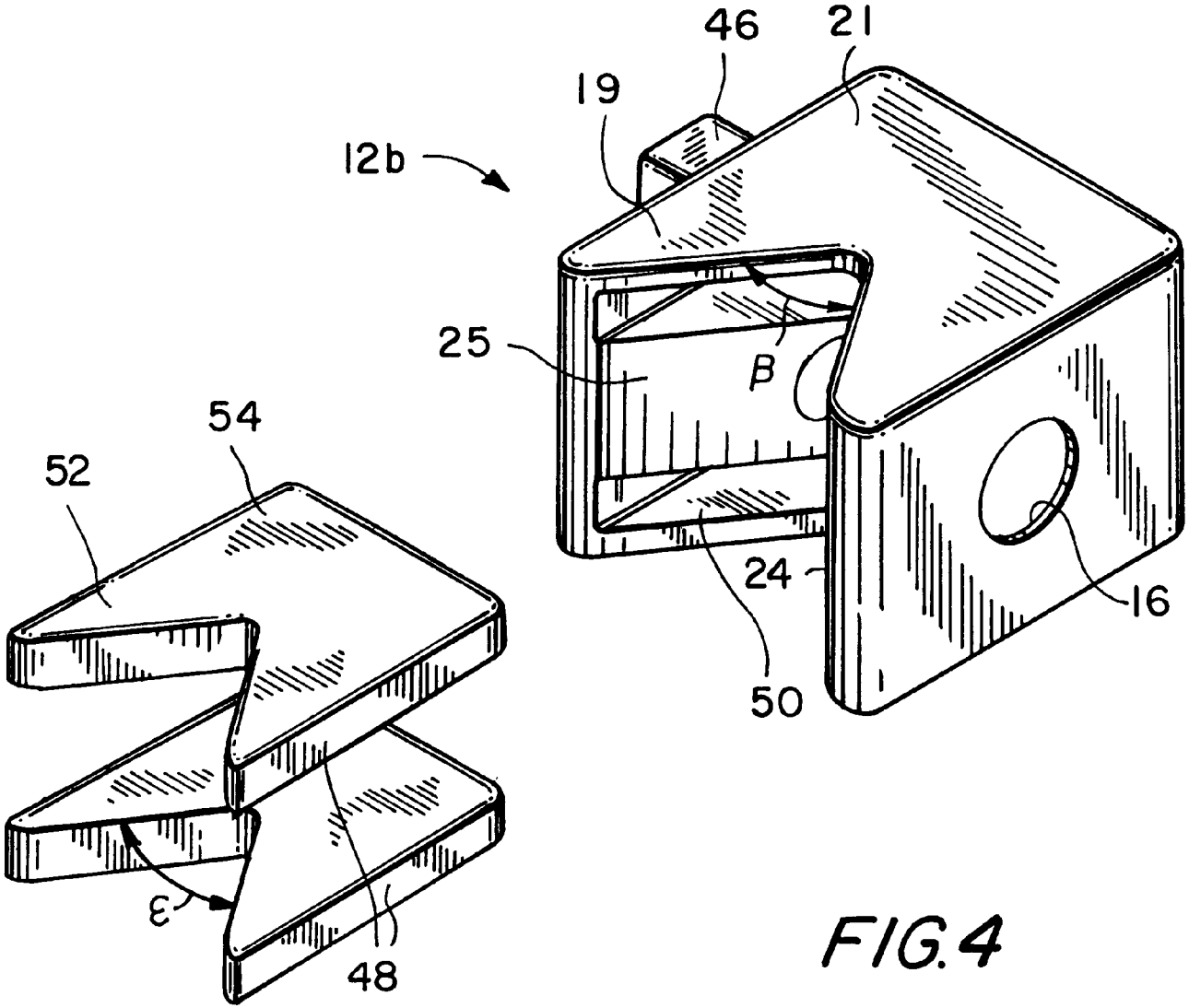
FIG. 4, a perspective view of a receiving and stop element.

The device 10 shown in FIG. 1 serves to guide and limit the travel of a sliding door element 1. Such sliding door elements 1 are used as a component of guard fences, for example to prevent access to security-related areas inside business premises. The sliding door element 1 is assembled from profile bars 2, 3 and a guide rail 4, which form a rectangular frame 5. A protective grid is disposed inside groove openings 6 of the profile bars 2, 3. The sliding door element 1 is displaceable in the direction X by known guide means, in particular rollers guided in guide rails, so that in the open state it allows access to the area bounded by the guard fence. In the closed state of the sliding door element 1, effected by a closing device, the profile bar 2 is located in the immediate vicinity of a post 7, which is a component of a stationary guard fence 8, not shown in further detail.

The device 10 includes a centering element 11, disposed on the sliding door element 1, and a receiving and stop element 12, disposed on the post 7 and aligned with the centering element 11. The centering element 11 and the receiving and stop element 12 are fastened, vertically adjustably, in longitudinal grooves 9 of the profile bar 3 and of the post 7 by means of screws 13 and sliding blocks 14; for receiving the screws 13, bores 16 are made in the centering element 11 and the receiving and stop element 12. As a rule, the centering element 11 and the receiving and stop element 12 are disposed in the lower or ground region of the sliding door element 1 and post 7. However, it is also possible for a plurality of devices 10 to be distributed over the height of the sliding door element 1 and the post 7.

The block-like centering element 11, which extends over virtually the full width of the profile bar 3, has two portions 17, 18. While one portion 17 is rectangular in cross section, the other portion 18 has a wedge-shaped form. This wedge-shaped portion 18 cooperates with a portion 19, cut out in a the shape of a V, of the also block-like receiving and stop element 12. The portion 19 is adjoined by a rectangular portion 21, so that the two portions 19, 21 together have a length L, which is virtually equal to the width B of the post 7 (which is square in cross section). The width B of the receiving and stop element 12 can also advantageously he approximately equal to the width A of the centering element 11. What is essential is that the wedge angle $\alpha$ of the portion 18 be equivalent to the opening angle $\beta$ of the portion 19, so that the cooperating faces 22, 23 and 24, 25 of the portions 18, 19 rest in plane fashion on one another, when the centering element 11 and receiving and stop element 12 are aligned with one another. The size of the gap between the profile bar 3 or the sliding door element 1 and the post 7, offset from it, of the guard fence 8 is thus determined by the length c of the portion 17.

Upon closure of the sliding door element 1, it is as a rule possible, because of the variations in the sliding door guide and its design, to move the sliding door element 1 transversely to the direction of motion X, so that the introduction of the centering element 11 with its wedge-shaped portion 18 into the receiving and stop element 12 takes place offset from the V-shaped portion 19 thereof. Consequently, the tip 26 of the wedge slides along one of the faces 24, 25 of the portion 19, and the centering element 11 is centered toward the receiving and stop element 12. What is essential for the lateral offset between the tip 26 of the wedge and the V-shaped portion 19 is that the offset be no greater than half the width a, so that the tip 26 of the wedge will still meet one of the faces 24, 25 of the portion 19.

To enable quiet introduction of the centering element 11 into the receiving and stop element 12 with simultaneous shock-absorbing action, the centering element 11 and/or the receiving and stop element 12 is of plastic, or is provided on at least one pair of faces, 22, 23 or 24, 25 with a damping layer 27, such as rubber or PUR. This damping layer 27 can be press-fitted with positive engagement or vulcanized on, and furthermore it can be shaped geometrically such that in the final position of introduction, fixation occurs by easy snapping into place between the elements 11 and 12.

In the second exemplary embodiment of the invention, shown in FIGS. 2 and 3, the centering element 11*a* and the receiving and stop element 12*a* of the device 10*a* are modified compared with the first exemplary embodiment. The centering element 11*a* has a block-like base region 28, which is adjoined by the substantially wedge-shaped guide portion 29. Above and below the guide portion 29, there is one receptacle each for a fastening screw 30 in the base region 28. Each fastening screw 30 cooperates with a sliding block, disposed in the longitudinal groove 9 of the profile bar 2, and with the aid of the sliding block, the centering element 11*a* can be fastened to the profile bar 2. A longitudinal slit 31, which opens into a longitudinal bore 32, is embodied in the longitudinal axis of the guide portion 29. The longitudinal slit 31 divides the guide portion 29 into two beak-shaped guide halves 33, 34. Each guide half 33, 34 has an oblique guide face 35, a center face 36 disposed parallel to the direction of motion X, and a retaining region 37 that widens again after the center face. The two guide faces 35 form an angle $\alpha^*$, and the two retaining regions 35 each have a radius r on the side remote from the base region 28.

The receiving and stop element 12*a* also has a base region 38 with recesses for fastening screws 30. The receiving region 40, offset from the base region 38, has a height H, which is equivalent to the height h of the guide portion 29. On the side toward the centering element 11*a*, the receiving region 40 has a substantially V-shaped receptacle with two receiving bevels 41, converging toward one another, which form an angle $\beta^*$. An essential feature is that the angle $\beta^*$ is greater than the angle $\alpha^*$ at the guide portion 29. Two insertion bevels 42, which form an angle that corresponds to the wedge angle $\alpha^*$ at the guide portion 29, adjoin the two receiving bevels 41 in the receiving region 40. The insertion bevel 42 is adjoined by a portion 43 disposed parallel to the direction of motion X. The spacing between the two portions 43, which represents the narrowest point of the receiving region 40, is somewhat greater than the outer spacing between the two center faces 36 on the guide portion 29. The two portions 43 merge with a common receiving opening 45, in which the two retaining regions 37 of the guide portion 29 can be disposed with little play (FIG. 3).

FIG. 3 also shows that the receiving and stop element 12*a* and the centering element 11*a* have centering extensions 46, which can be disposed in the grooves 9. As a result, an exact alignment on the profile bars 6, 7 is possible. Furthermore, a protection against twisting is assured after assembly.

When the centering element 11*a* is introduced into the receiving and stop element 12*a*, the two retaining regions 37 of the centering element 11*a* slide along the receiving bevels 41 into the region of the insertion bevels 42. Depending on the speed with which the retaining regions 37 strike the receiving bevels 41, a deformation of the guide halves 33, 34 occurs as a consequence of the longitudinal slit 31, which is equivalent to a damping of the impact motion of the sliding door element 1. For further introduction of the centering element 11*a* into the receiving and stop element 12*a*, the two guide halves 33, 34 must be elastically deformed, in such a way that the two retaining regions 37 can move past the region of the portions 43, so that they can enter the receiving opening 45 that follows. The resistance to be overcome to that end is dependent in particular on the spacing of the two portions 43 and on the dimensioning and material of the guide portion 29. If the two retaining regions 37 are located inside the receiving opening 45 of the receiving and stop element 12*a*, then the sliding door element 1 is secured or locked with respect to the direction of motion X in such a way that to re-open the sliding door element 1, a resistance must first be overcome in order to move the retaining regions 37 back out of the receiving opening 45 again. Therefore, whenever all that has to be guarded against is access by mistake to some portion of business premises, it is conceivable to dispense with additional closing devices on the sliding door element 1.

In FIG. 4, compared to the first exemplary embodiment, a modified receiving and stop element 12*b* with damping elements 48 is shown in an exploded view. The damping elements 48 are an alternative but analogous possibility, compared with the damping layer 27 already described, for making it possible to achieve quiet introduction of the centering element 11 of the first exemplary embodiment into the receiving and stop element 12*b* with simultaneous shock-absorbing action.

In the receiving and stop element 12*b*, beginning at the faces 24, 25, two recesses 50 are formed, which in the present exemplary embodiment have a rectangular cross-sectional shape. However, it is also possible for the recesses 50 to have some other cross-sectional shape, such as round or oval. The recesses 50 serve to receive the damping elements 48, whose shape is adapted for this purpose to the shape of the recesses 50. The damping elements 48 have a V-shaped first portion 52, which is adjoined by a second, rectangular portion 54. The opening angle $\epsilon$ of the V-shaped portion 52 corresponds essentially to the opening angle $\beta$ of the V-shaped portion 19 of the receiving and stop element 12*b*. The damping elements 48 disposed in the recesses 50 protrude somewhat past the faces 24, 25, and as a result the damping ensues upon introduction of the centering element 11 into the receiving and stop element 12*b*. The damping elements 48 are preferably made of a soft material. This can be polyurethane, rubber, or some other suitable plastic.

For assembly, the damping elements 48 are inserted, with the second portions 54 leading, into the recesses 50, in which they preferably have a slight press fit. However, the damping elements 48 can also be fastened by means of adhesive. Nevertheless, a suitable press fit makes an easy replacement of worn damping elements 48 possible.

Instead of the two damping elements 48 shown, some other number can also be provided. With respect to the damping elements 48, it is possible for the receiving and stop element 12*b* and/or the centering element 12*b* to have at least one damping element 48. The damping element 48 is disposed here in a recess 50, which is embodied in the receiving and stop element 12*b* and/or in the centering element 11.

Figure 5:
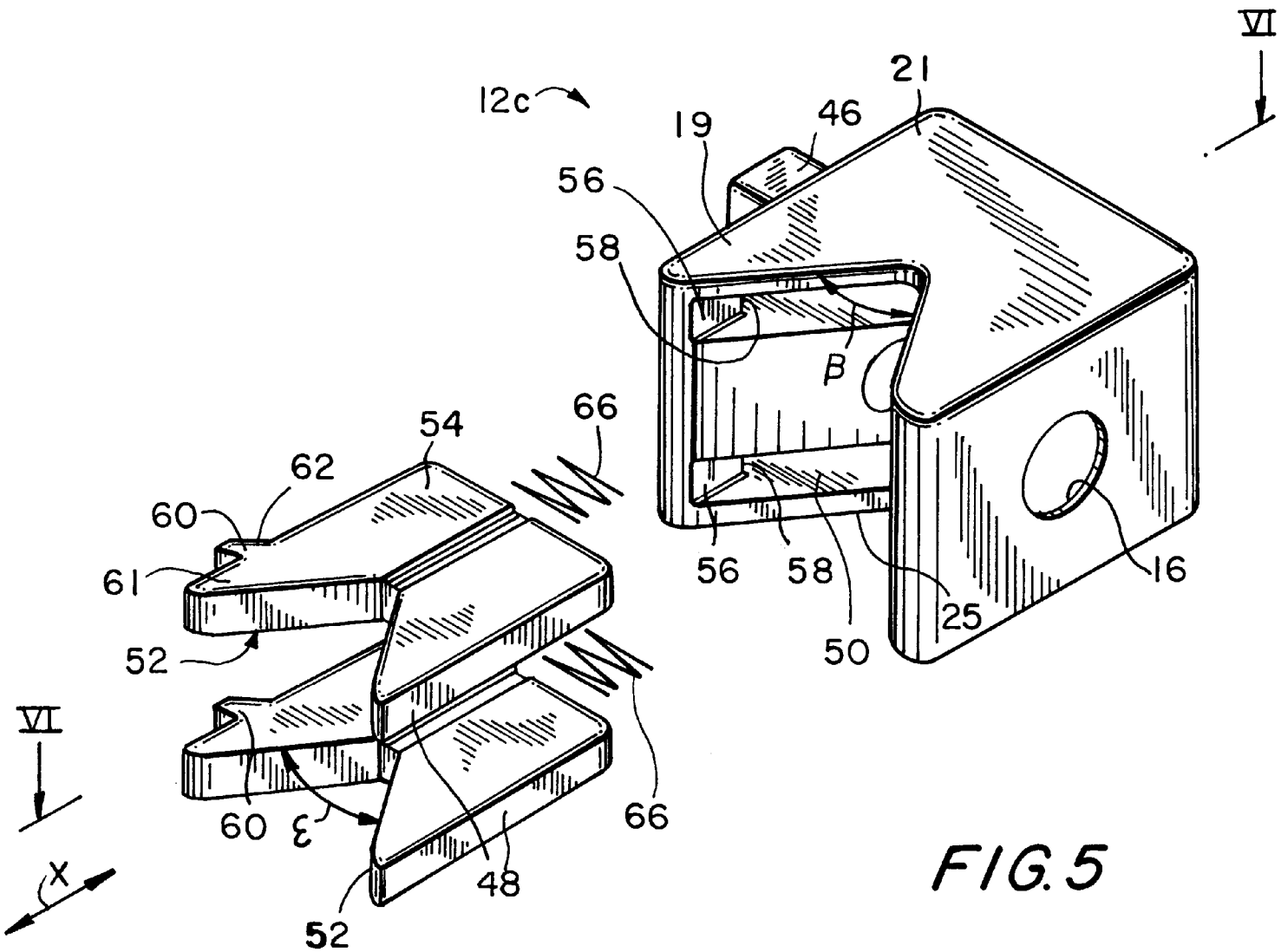
FIG. 5, a perspective view of a modified receiving and stop element.
Figure 6:
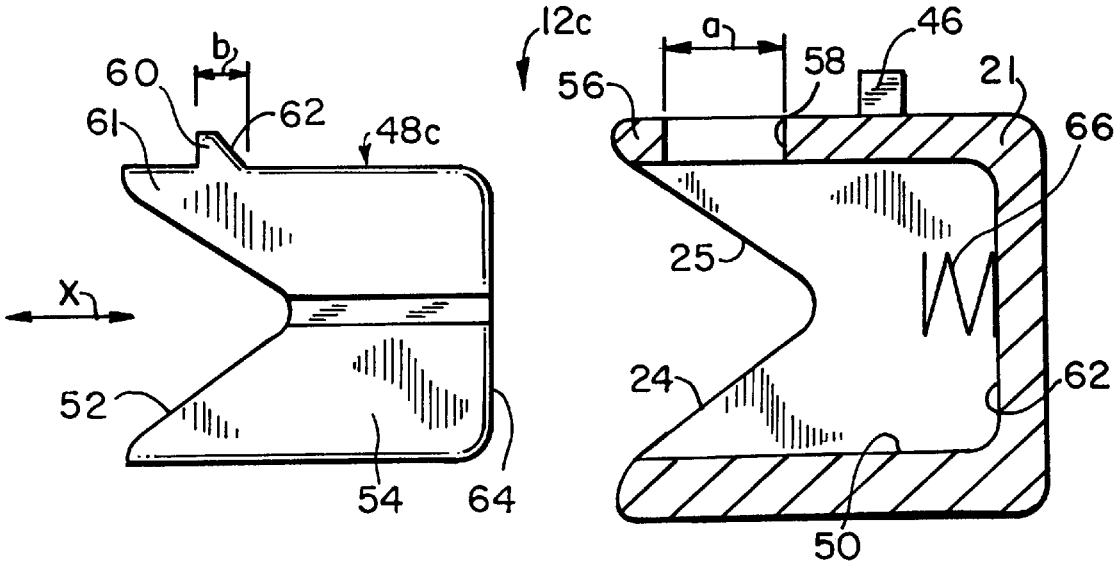
FIG. 6, a view taken along the section lines VI—VI in FIG. 5.

In FIGS. 5 and 6, a modified receiving and stop element 12*c* compared with the previous exemplary embodiment is shown in an exploded view. In a side wall 56 of the recess 50, a through opening 58 is made. However, it can also be merely an indentation. A through opening 58, nevertheless, is easier to produce from a production standpoint. In the direction of motion X, the through opening 58 has a length a.

The two damping elements 48*c*, of which there should be at least one, have at least one extension 60 embodied on them for securing the damping element 48*c* in the recess 50, and this extension can be disposed in the through opening 58. It is also possible for two extensions 60 facing one another in mirror symmetry to be provided on the damping element 48*c*. Preferably, the extension 60 is embodied on one long side of a branch 61 of the portion 52 and ideally has an insertion bevel 62 for the sake of easier assembly. In the direction of motion X, the extension 60 has a length b. The length a of the through opening 58 is preferably greater than the length b of the extension 60, so that the damping element 48*c* is axially displaceable in the recess.

A spring element 66 is disposed between the bottom 62 of the recess 50 and the damping element 48*c*, or more precisely the face end 64 of the damping element 48*c*. This produces an additional resilient property. However, the spring element 66 can also be dispensed with.

For assembly of the receiving and stop element 12*c*, the spring elements 66 are first placed in the recesses 50. Then the damping elements 48*c*, with the second portions 54 leading, are thrust into the recesses 50, in which the damping elements 48*c* preferably have a clearance fit. When the insertion bevels 62 of the extensions 60 come to rest on the wall 56 and the damping elements 48*c* are thrust further into the recesses 60, the branch 61 of the V-shaped portions 52 is pressed toward the middle of the damping elements 48*c*. As a result, the damping elements 48*c* can easily be thrust all the way into the recesses 50. As soon as the extensions 62 enter the region of the through openings 58, the branches 61 of the V-shaped portions 52 snap in the direction of the through openings 58. The extensions 60 are disposed in the through openings 58, and as a result the damping elements 48*c* in the recesses 50 are secured against falling out. Because the length a of the through openings 58 is greater than the length b of the extensions 60, the damping elements 48*c* can be displaced somewhat in the direction of motion X, which produces better damping and spring properties. It should also be noted that the spring elements 66 act upon the damping elements 48*c* in the unloaded state in such a way that the damping elements 48*c* protrude somewhat past the faces 24, 25.

For disassembly of a worn damping element 48*c*, pressure must merely be exerted from outside against the extension 60. The damping element 48*c* can immediately be removed easily from the recess 50.

Figure 7:
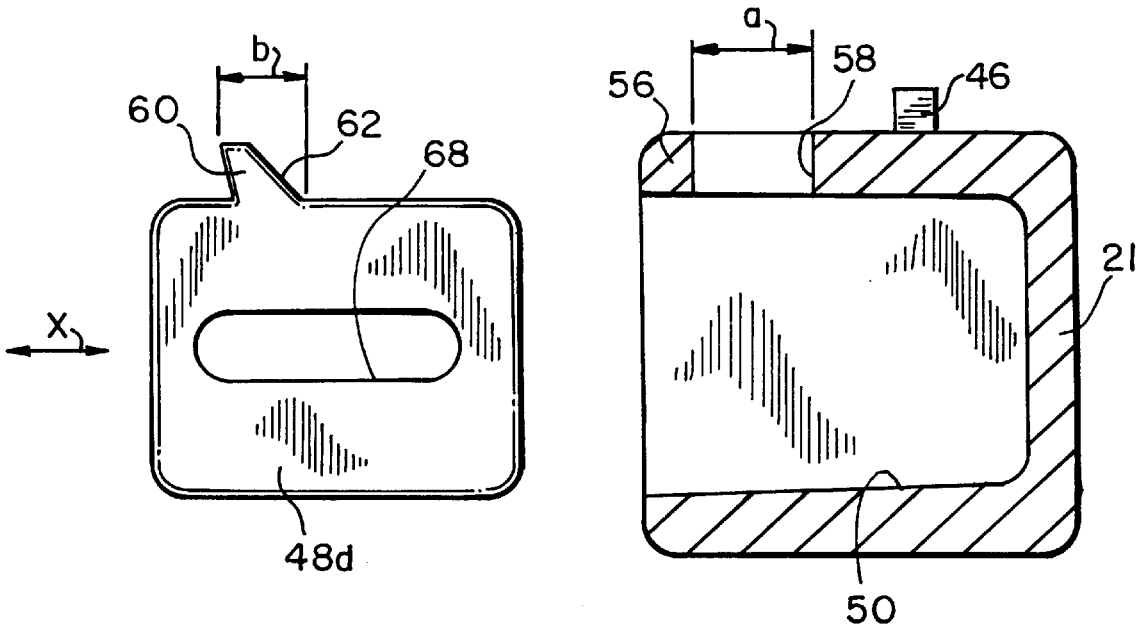
FIG. 7, a section analogous to that of FIG. 6, through a further modified receiving and stop element.

FIG. 7 shows an alternative embodiment of a damping element 48*d*. Through a slit 68, which extends through the damping element 48*d*, the damping element can also be pressed together in such a way that it can easily be introduced into the recess 50. As a result, the extension 60 can also be provided even on a portion 52 that is not V-shaped.

What is claimed is:

1. A device for guiding and limiting a travel of a sliding door element, comprising a center element; a receiving and stop element which cooperates with positive engagement with said centering element, said receiving and stop element for guiding said centering element having a receiving region for said centering element, said region widening in a direction toward said centering element; a profile bar to which said receiving and stop element and said centering element are connectable; and fastening parts which connect said receiving and stop element and said centering element to said profile bar, wherein said profile bar has grooves, said fastening parts being disposed in said grooves of said profile bar, and wherein said receiving and stop element and said centering element are vertically adjustable.

2. A device as defined in claim 1, wherein said centering element has a wedge-shaped portion, said receiving region being at least partially formed with a shape of a V and cooperating with said wedge-shaped portion of said centering element.

3. A device as defined in claim 1, wherein said receiving and stop element and said centering element are formed of one piece with one another.

4. A device as defined in claim 1 wherein said receiving and stop element and said centering element have centering extensions which are disposable in said grooves.

5. A device as defined in claim 1, wherein said receiving and stop element and said centering element have means for locking the sliding door element in a closed position.

6. A device as defined in claim 5, wherein said centering element has at least one extension, said means having a retaining opening adjoining a bottom of said receiving opening into which said at least one extension of said centering element is introducable, said at least one extension being retained in said retaining opening by positive engagement.

7. A device as defined in claim 6, wherein said bottom of said receiving element has a constriction which is adjoined by said retaining opening, said at least one extension having a thickened region adapted at least in part by positive engagement to said receiving opening, and an element selected from the group consisting of said constriction and said at least one extension being deformable for introducing of said at least one extension into said retaining opening.

8. A device as defined in claim 7, wherein said centering element has a wedge-shaped portion with a longitudinal slit oriented in a longitudinal direction of said receiving opening, that divides said wedge-shaped portion into two extensions, said extensions being elastically deformable transversely to said longitudinal slit.

9. A device as defined in claim 1, wherein said receiving and stop element and said centering element are composed at least partially of plastic.

10. A device as defined in claim 1, wherein at least one of said receiving and stop element and said centering element has a damping layer.

11. A device for guiding and limiting a travel of a sliding door element, comprising a center element; a receiving and stop element which cooperates with positive engagement with said centering element, said receiving and stop element for guiding said centering element having a receiving region for said centering element, said region widening in a direction toward said centering element; a profile bar to which said receiving and stop element and said centering element are connectable; and fastening parts which connect said receiving and stop element and said centering element to said profile bar, wherein said centering element has a wedge-shaped portion with a longitudinal slit oriented in a longitudinal direction of said receiving region and dividing said wedge-shaped portion into two extensions, said extensions being elastically deformable transversely to said longitudinal slit.

12. A device for guiding and limiting a travel of a sliding door element, comprising a center element; a receiving and stop element which cooperates with positive engagement with said centering element, said receiving and stop element for guiding said centering element having a receiving region for said centering element, said region widening in a direction toward said centering element; a profile bar to which said receiving and stop element and said centering element are connectable; and fastening parts which connect said receiving and stop element and said centering element to said profile bar, wherein at least one of said receiving and stop elements and said centering element has a recess, at least one of said receiving and stop elements and said centering element also having at least one damping element disposed in said recess.

13. A device as defined in claim 12, wherein said recess has one wall provided with a through opening, said at least one damping element having at least one extension for securing said damping element in said recess, said extension being disposed in said through opening.

14. A device as defined in claim 13, wherein said extension has an insert bevel.

15. A device as defined in claim 13, wherein said damping element has a clearance fit in said recess.

16. A device as defined in claim 13, wherein said through opening has a length which is greater than a length of said extension, so that said damping element is axially displaceable in said recess.

17. A device as defined in claim 13; and further comprising a spring element disposed in a bottom of said recess of said damping element.

* * * * *